US010243277B2

(12) United States Patent
Chang et al.

(10) Patent No.: US 10,243,277 B2
(45) Date of Patent: Mar. 26, 2019

(54) COMPACT PATCH ANTENNA ARRAY

(71) Applicant: Donald C. D. Chang, Thousand Oaks, CA (US)

(72) Inventors: Donald C. D. Chang, Thousand Oaks, CA (US); Yuanchang Liu, Canoga Park, CA (US)

(73) Assignee: SPATIAL DIGITAL SYSTEMS, INC., Agoura Hills, CA (US)

( * ) Notice: Subject to any disclaimer, the term of this patent is extended or adjusted under 35 U.S.C. 154(b) by 949 days.

(21) Appl. No.: 14/072,801

(22) Filed: Nov. 6, 2013

(65) Prior Publication Data

US 2016/0226154 A1 Aug. 4, 2016

Related U.S. Application Data

(63) Continuation of application No. 12/847,941, filed on Jul. 30, 2010, now Pat. No. 8,643,562.

(51) Int. Cl.

| | |
|---|---|
| ***H01Q 21/06*** | (2006.01) |
| ***H01Q 1/24*** | (2006.01) |
| ***H01Q 21/00*** | (2006.01) |
| ***H01Q 21/20*** | (2006.01) |

(52) U.S. Cl.

CPC ..... *H01Q 21/065* (2013.01); *H01Q 1/243* (2013.01); *H01Q 21/0075* (2013.01); *H01Q 21/20* (2013.01)

(58) Field of Classification Search

CPC ..... H01Q 13/18; H01Q 5/364; H01Q 1/243; H01Q 1/2266

See application file for complete search history.

(56) References Cited

U.S. PATENT DOCUMENTS

| | | | | |
|---|---|---|---|---|
| 5,220,335 | A | 6/1993 | Huang | |
| 5,455,594 | A | 10/1995 | Blasing et al. | |
| 5,572,222 | A | 11/1996 | Mailandt et al. | |
| 5,764,189 | A | 6/1998 | Lohninger | |
| 6,091,364 | A * | 7/2000 | Murakami | H01Q 1/084 343/700 MS |
| 6,295,028 | B1 | 9/2001 | Jonsson et al. | |
| 6,473,040 | B1 | 10/2002 | Nakamura | |
| 6,901,364 | B2 | 3/2005 | Nguyen et al. | |
| 7,064,713 | B2 | 6/2006 | Koening | |
| 7,205,953 | B2 | 4/2007 | Knadle, Jr. et al. | |
| 7,292,201 | B2 | 11/2007 | Nagaev et al. | |

* cited by examiner

*Primary Examiner* — Jessica Han
*Assistant Examiner* — Michael M Bouizza
(74) *Attorney, Agent, or Firm* — Phuong-Quan Hoang

(57) ABSTRACT

A compact patch antenna array for mobile terminal applications comprising: a plurality of radiators mounted on one surface of a dielectric, with a ground plane being mounted on the other side of the dielectric. Beneath the ground plane, another dielectric with feeding network is placed. Other embodiments are described and shown in FIG. 2.

20 Claims, 6 Drawing Sheets

COMPACT PATCH ANTENNA ARRAY

This application is a continuation of application Ser. No. 12/847,941, filed on Jul. 30, 2010, now pending.

BACKGROUND

1. Field

The present invention relates to architectures and designs of patch antenna.

2. Prior Art

The following is a tabulation of some prior art that presently appears relevant:

U.S. Patents

| Patent Number | Kind Code | Issue Date | Patentee |
|---|---|---|---|
| 5220335 | | 1993 Jun. 15 | Huang |
| 5572222 | | 1996 Nov. 5 | Mailandt et al. |
| 6295028 | B1 | 2001 Sep. 25 | Jonsson et al. |
| 6473040 | B1 | 2002 Oct. 29 | Nakamura |
| 7064713 | B2 | 2006 Jun. 20 | Koening |
| 7205953 | B2 | 2007 Apr. 17 | Knadle, Jr. et al. |
| 7292201 | B2 | 2007 Nov. 6 | Nagaev et al. |

NON-PATENT LITERATURE DOCUMENTS

Ali, M. T. et al., *Antenna Technology* (*iWAT*), 2010 *International Workshop*, "A Reconfigurable Planar Antenna Array (RPAA) with back lobe reduction"

In wireless satellite communications, ground terminals typically employ one or more antennas to transmit and receive radio waves to and from satellites or other ground terminals. Dish antennas have traditionally been the predominant antenna shape for satellite communications applications, with fixed terminals utilizing large dish antennas that may reach up to several meters in diameter. However, prerequisites for mobile terminals are different from those of fixed terminals, with dish antennas proving to be too large and bulky to be practical for mobile use. While some mobile terminals use dish antennas such as on mobile television trucks, even smaller mobile terminals may call for more practical antenna shapes. For example, having a dish-shaped object mounted on a small, hand held device such as a Global Positioning System (GPS) handset would be too cumbersome and awkward to be carried around. Instead, mobile applications call for antennas that tend to be more compact and portable than fixed terminals, utilizing more efficient shapes for practical use, such as a flat plane. Following a portability and compact size trend with no or slight trade-off in performance, smaller antennas are generally preferred for mobile terminal applications.

However, due to the physical properties of mobile applications, smaller antennas for mobile terminals tend to have less power output (thus less signal strength), narrower bandwidth due to the smaller physical size, and low gain. The advent of patch antennas has given new strength in the search for mobile terminal antenna applications that is able to retain compactness, mobility, functionality, while retaining the flexibility and power of a larger, fixed terminal.

A patch antenna is comprised of a thin layer of dielectric with a piece of metal, called a radiator, mounted on one side and a ground plane mounted on the other. It is well known that single patch antenna possesses several advantages over other antennas such as light weight, conformability, low profile, and low cost. Yet, it suffers from disadvantages like narrow bandwidth because of high quality factor and low gain because of small radiation area. Additionally, due to different applications, various radiation patterns are required, which is really hard for antenna designers to implement due to the limited degree of freedom allowed by patch antenna design.

To overcome such disadvantages, there has been research on patch antenna design, with previous works were mainly concentrated on forming antenna arrays using several patch antennas. In this manner, patch antennas not only function as a bigger radiating element. Additionally, the radiation pattern for patch antenna arrays can be shaped through adjusting the relative position of antennas. This makes arrays flexible enough to change its shape to suit the needs of the user. For example, if two antennas are in phase at a direction, which means electric fields created by the antennas are strong or weak at the same time, radiation at this direction is enhanced, employing what is known as the beam-forming technique. If two antennas are out of phase, which means electric fields created by the antennas are equally strong but opposite direction, the electric fields will cancel out and there is no radiation at this direction, known as creating null.

However, this setup requires an extra feeding network to connect these antennas. This feeding network is used to excite the antennas. It may contain power combiners, amplifiers, and filters. Specific components of the feeding network depend on design requirements. And it usually has to be provided separately, which violates the main advantage of patch antenna, space efficiency.

SUMMARY OF THE INVENTION

The present invention is an improvement on mobile satellite communication antenna design, specifically regarding that of patch antenna arrays for mobile terminal applications. These antenna arrays alleviate several problems associated with small antennas, such as low output, narrow bandwidth, and low gain. Specifically, in accordance with one embodiment, the present invention is a compact patch antenna array comprising: radio wave radiators, a ground plane, and a dielectric. The antenna design further comprises a feeding network mounted on a flat dielectric, serving as a device to provide power to the radiators.

With embodiments described later, but not limited to, a compact design is achieved while maintaining flexible and practical signal output. Additionally, because it utilizes array concepts, radiation pattern shaping is easy due to the ability to create different shaped antenna array patterns. For example, a planar array (where the radiating elements are all situated on the same plane, facing the same direction) is a common shape for a patch antenna array. However, a non-planar array can be constructed just as easily under such architecture, with shape being further adjustable depending on the application and needs for the shape.

Further advantages and applications of embodiments will become clear to those skilled in the art by examination of the following detailed. Reference will be made to the attached sheets of drawing that will first be described briefly.

DRAWINGS-Reference Numerals

| | | | |
|---|---|---|---|
| 102 | Dielectric for radiators | 104, a, b, c, d | Radiators |
| 106, a, b | Ground | 108 | Dielectric for feeding network |
| 110 | Pins for connecting radiators with feeding network | 112 | Feeding network |
| 202 | Radiation pattern of a single antenna element | 204 | Radiation pattern of a coplanar embodiment |
| 304, a, b, c, d | Non-planar radiators | 502a, b, c, d | Non-planar radiators |
| 504 | Ground | 506 | Dielectric for radiators |
| 508 | Dielectric for feeding network | 510 | Feeding network |
| 602 | Radiation pattern of a non-planar embodiment | | |

DETAILED DESCRIPTION OF THE PREFERRED EMBODIMENT

Figure 1A:
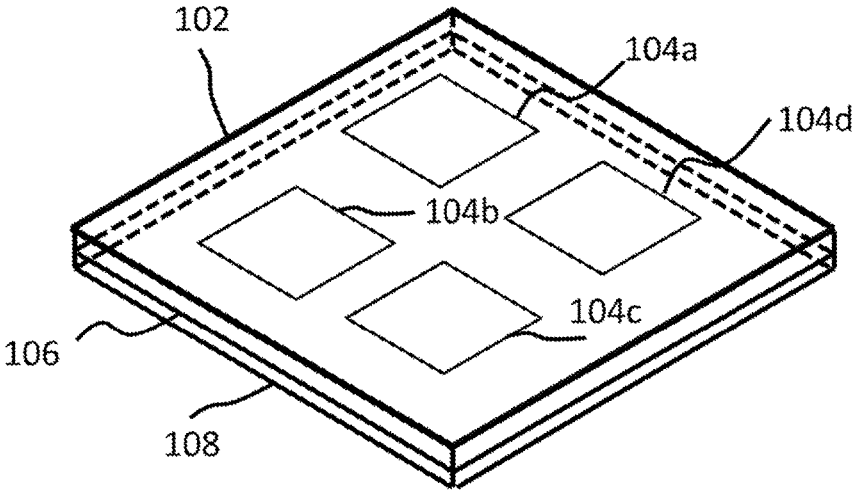
FIG. 1*a* depicts an exemplary coplanar architecture of a compact patch antenna array.
Figure 1B:
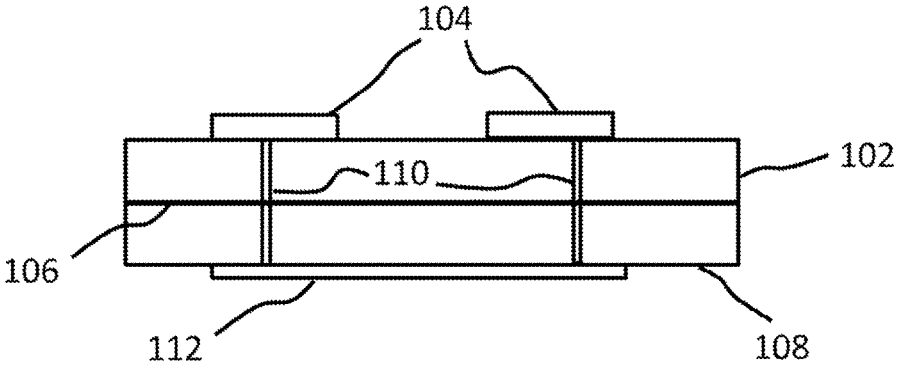
FIG. 1*b* shows side view of a patch antenna array.

One embodiment of the compact antenna array is shown in FIG. 1*a* and FIG. 1*b*, example of a coplanar array comprised of 4 antenna elements. However, the number of elements does not have to be 4; it can be any number more than one. The placement of the antennas doesn't have to be coplanar. Non-coplanar will also work, which will be discussed in alternative embodiment.

In this embodiment, as illustrated in FIG. 1*a* and FIG. 1*b*, multiple radiators 104*a,b,c,d* are mounted on one side of flat-surfaced dielectric 102. Lying flush with the opposite side of dielectric 102 is ground 106, which is shared by patch antennas and the feeding network 112. Additionally, there is another piece of dielectric 108 lying under the ground. As shown in FIG. 1*b*, from the side view it is clear that feeding network 112 is mounted on surface of the dielectric 108. Pins 110 are used to connect radiators and feeding network.

Further, dielectric 102 and dielectric 108 can be of the same material or made of different materials, which improves design flexibility. Moreover, as in this embodiment both the antenna array and the feeding network are microstrips, the whole structure is relatively low cost.

To utilize this embodiment in an advanced design, the feeding network may also function as a beam forming network. Mismatches of feeding trace among radiating elements create phase differences which perform the same function as the beam weight vectors of a beam forming network. This creates several advantages as following. Instead of providing a single summed up output, the feeding network can output multiple beams. These multiple output beams can be in various forms. For example, they can be beams pointing to different locations. They can be beams of different polarizations, i.e., some outputs for horizontal polarized while the others for vertically polarized in linear polarization. Circular polarizations can also be used, with some outputs for left hand circular polarized (LHCP) while others can be for right hand circular polarized (RHCP) in circular polarization. The antenna array can transmit beams of different frequency bands, for example in GPS application, some outputs for 1.57542 GHz and others for 1.2276 GHz. Additionally, the above options can be combined together, illustrated by how one output can be 1.5 GHz LHCP pointing to the west while another can be 1.2 GHz RHCP pointing to the east.

Figure 2A:
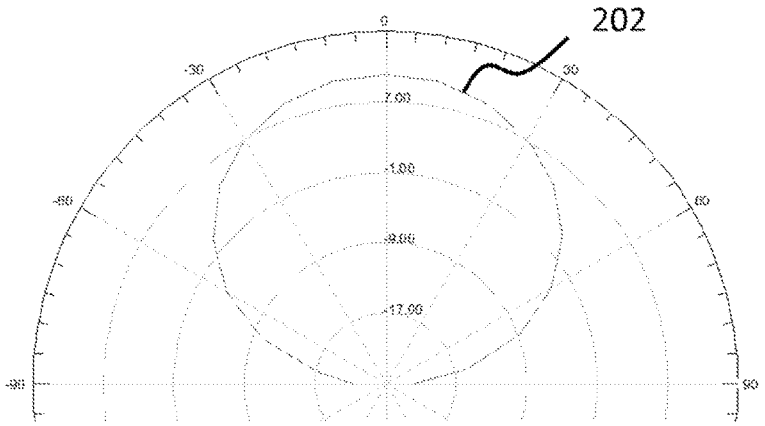
FIG. 2*a* illustrates radiation patterns of a single antenna element.
Figure 2B:
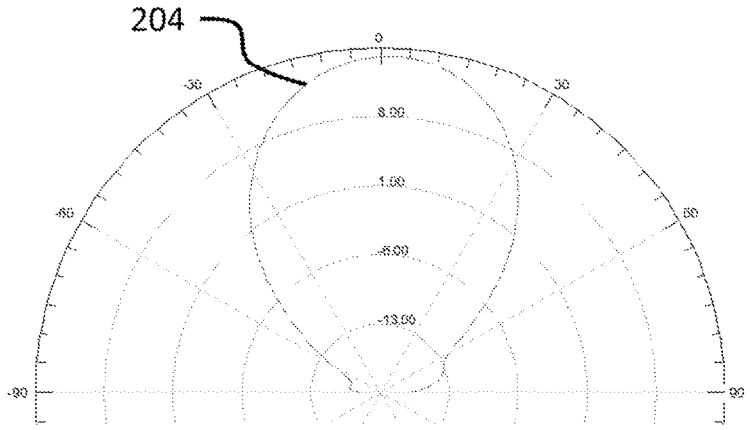
FIG. 2*b* illustrates radiation patterns of whole architecture shown in FIG. 1*a;*

Performances of a single element in FIG. 1*a* and the whole architecture are compared in FIG. 2*a* and FIG. 2*b*. Radiation pattern 202 is a plane cut at $\theta=0°$ of the single element. Radiation pattern 204 is the same curve of the whole array. Peak gain, the maximum point of the curve, of curve 202 is around 9 dB while peak gain of 204 is about 14 dB. We can see the whole structure improve the peak gain by some 5 dB. Plus, beam width of 204 is much narrower than 202, which means the whole structure also changes the beam shape.

Alternative Embodiment 1

Figure 3A:
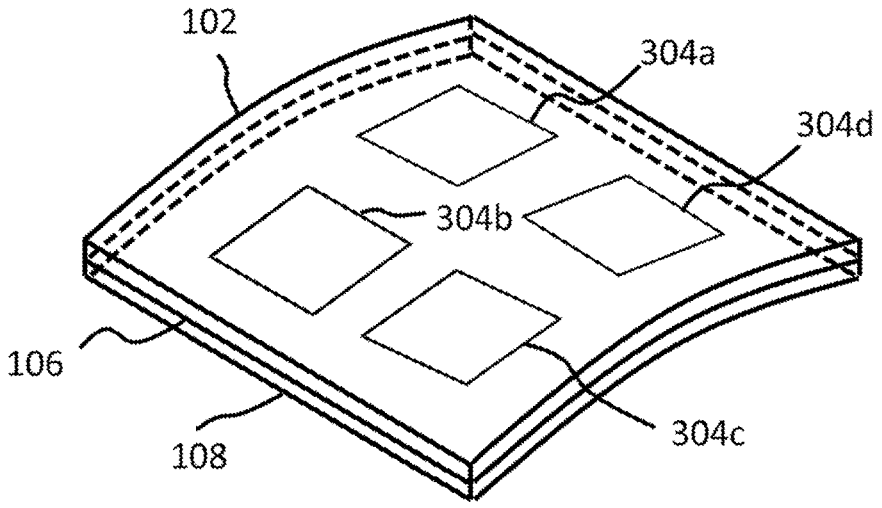
FIG. 3*a* shows an exemplary conformal architecture of a compact patch antenna array.
Figure 3B:
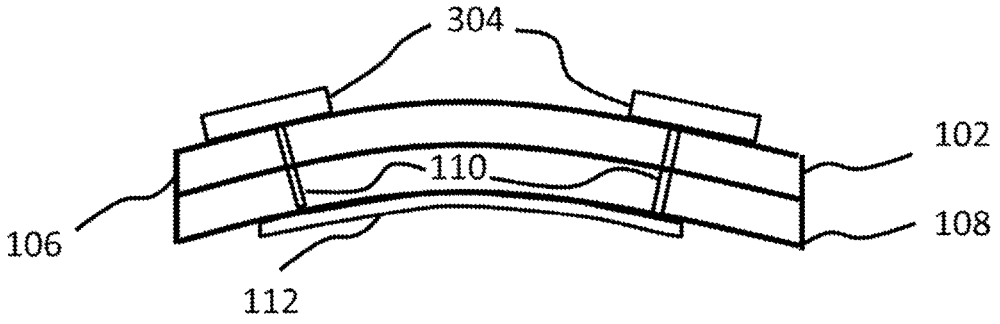
FIG. 3*b* depicts side view of FIG. 3*a;*

Besides the embodiment described previously, another implementation of radiators are also useful. As shown in FIG. 3*a* and FIG. 3*b*, an example of a conformal array is presented. Again, number of elements is not restricted to 4 but any number more than one.

In this embodiment, all antenna elements are implemented on an exemplary curve structure, not limited to the shown curve, instead on any curve that is not planar. This embodiment is very useful when ultra-compact capability is required. For example, with this design, aircraft antenna systems would not have to be implemented separately. It could be part of the body. Further applications can be found in missiles, as they have a strict requirement for ultra-compact arrays while maintaining high levels of power output and gain. With this structure, part of the body could be used as an antenna, which is very space efficient.

Alternative Embodiment 2

Figure 5A:
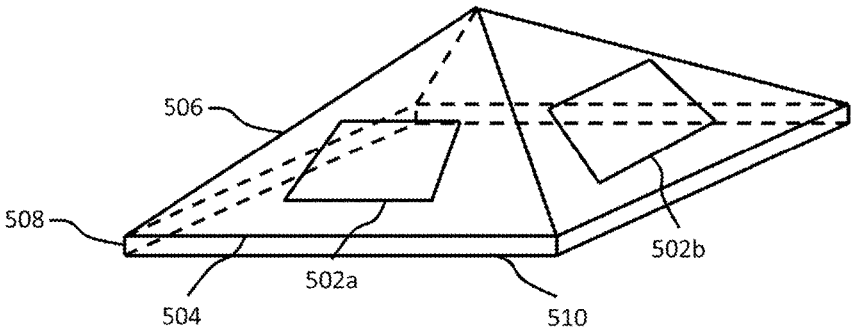
FIG. 5*a* depicts another exemplary non-coplanar architecture.
Figure 5B:
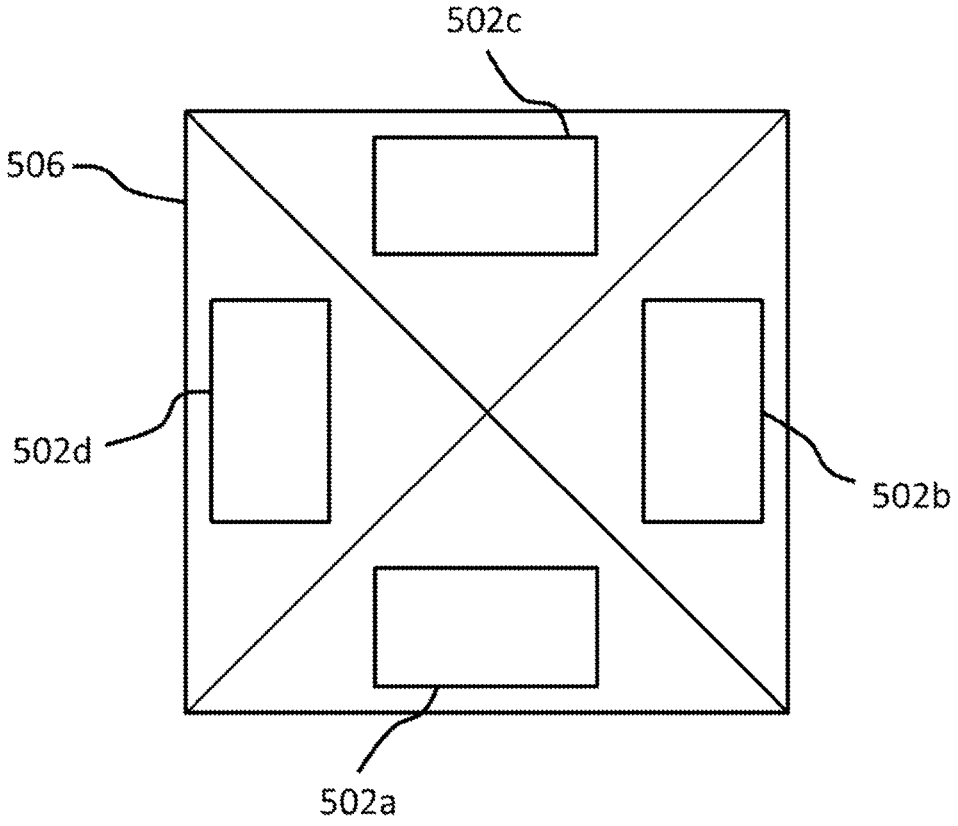
FIG. 5*b* shows top-down view of FIG. 5*a;*
Figure 5C:
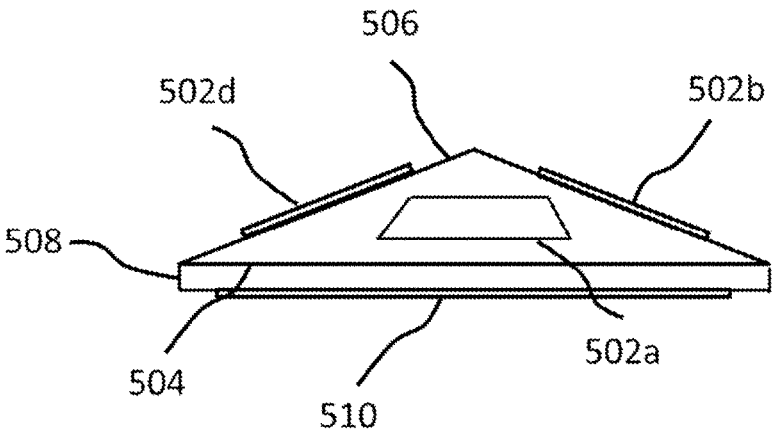
FIG. 5*c* shows side view of FIG. 5*a.*

Another useful alternation of this design is shown in FIG. 5*a* and FIG. 5*b*. In this embodiment, each antenna element 502*a,b,c,d* is facing a different direction. In such a way, because radiations on the side are enhanced significantly that rather than concentrating all power on bore sight, the radiation pattern becomes flat and wide.

Figure 6:
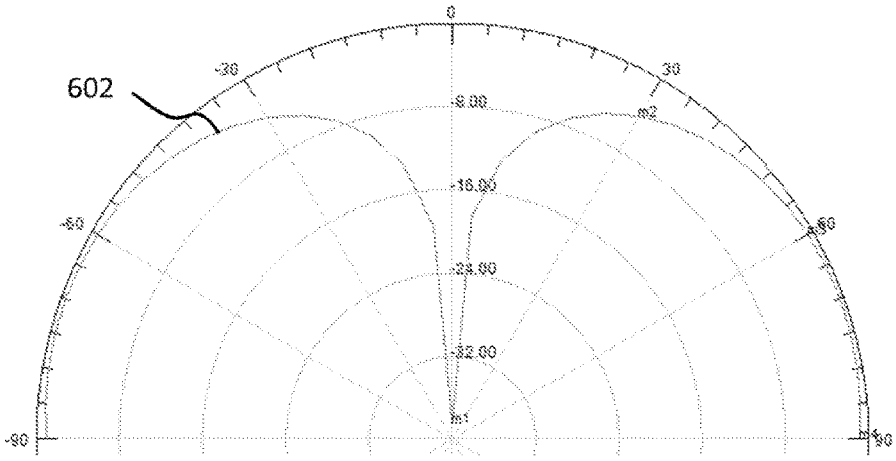
FIG. 6 shows a radiation pattern of a non-planar embodiment.

Radiation pattern of a non-planar embodiment 602 in FIG. 6 shows an exemplary performance of this embodiment. Radiation pattern of a non-planar embodiment 602 is a plane cut at $\theta=0°$. There are several points on this curve to be noticed. Gain at $\theta=30°$ is −4 dB. Gain at $\theta=60°$ is −0.5 dB. Gain at $\theta=90°$ is −0.8 dB. Thus this embodiment forms a relatively flat radiation pattern on its side with minimum reception on bore sight, $\theta=0°$.

In global navigation satellite systems (GNSS), including GPS, Galileo, Glonass and Beidou, satellites are for the majority of the time never right above users at the $\theta=0°$ angle. Due to the angles between a ground terminal and a satellite, the satellites are commonly at an angle and to the side of ground terminals. Additionally, 70% of the time the satellite is overhead is with the satellite being off to the side relative to the ground terminal, with only about 30% of the time being directly overhead. With previous design, the satellites are useful only after are situated at bore sight relative to users. At these times, relative speed, which causes the Doppler Effect, is the fastest, because satellites move the fastest on top. Nevertheless, with this embodiment, there is no poor reception when satellites are on side of users any more. GNSS performance can be improved significantly. This is because the radiation patterns better suit relative satellite positions for GNSS due to the direction of peak gain.

In direct broadcasting business, satellites are placed at geostationary orbit. Except on the equator, users do not have satellites right above them at the zero degree angle. With this side reception enhanced embodiment, direct broadcasting users will have better performance than before. Other than just receiving signals in direct broadcasting, this concept also improves communications, including receiving and transmitting, with geostationary satellites.

All of these great features will work both on stationary and mobile terminals, ranging from a television station to a handheld GPS terminal. This is due to the more flexible radiator design, utilizing multiple small radiators to not only function as a larger radiator but also having an adaptable array.

Alternative Embodiment 3

Figure 4:
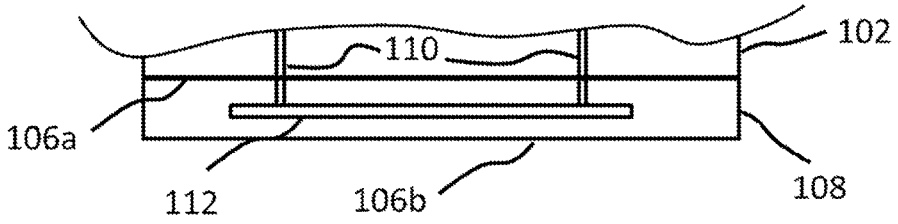
FIG. 4 shows side view of an embodiment with stripline feeding network.

Apart from different implementations on antenna array, the feeding network can be implemented in various ways. Previously discussed feeding networks and antenna arrays are in the form of microstrips. Alternatively, in another embodiment the feeding network can also be strip line as shown in FIG. 4. In FIG. 4 the feeding network 112, instead of being mounted on the surface of dielectric 108, the feeding network 112 is placed within dielectric 108. This integration of two elements into a single space serves to increase redundancy and save some space.

Alternatively, instead of directly exiting the radiators, the feeding network 112 can excite radiator 104 by coupling, which means the feeding network 112 doesn't necessarily directly contact the radiator 104.

We claim:

1. An antenna module comprising:

a ground layer having a first ground surface and a second ground surface opposite of the first ground surface;

a first dielectric layer having a first dielectric surface and a second dielectric surface, the first dielectric surface being disposed over the first ground surface, the second dielectric surface having a curve structure;

a second dielectric layer having a third dielectric surface and a fourth dielectric surface, the third dielectric surface being disposed over the second ground surface such that the ground layer is placed between the first and second dielectric layers;

a plurality of antenna elements being in an array arrangement and disposed on the curve structure of the second dielectric surface;

a feeding network being disposed over the fourth dielectric surface or placed within the second dielectric layer, wherein the feeding network is coupled to the antenna elements and wherein the feeding network is configured to function as a beam forming network and output concurrently a plurality of beams shaped according to the array arrangement of the antenna elements; and a plurality of pins connecting the feeding network to the antenna elements through at least the ground layer and the first dielectric layer.

2. The antenna module of claim 1, wherein mismatches of feeding traces create phase differences which perform as beam weight vectors of the beam forming network.

3. The antenna module of claim 1, wherein the antenna elements face different directions.

4. The antenna module of claim 1, wherein the feeding network is coupled to each of the antenna elements through a via.

5. The antenna module of claim 1, wherein the feeding network is configured to output concurrently the shaped beams that have different frequency bands.

6. The antenna module of claim 1, wherein the feeding network is configured to output concurrently the shaped beams that have different polarizations.

7. The antenna module of claim 1, wherein the antenna elements form a conformal array.

8. An antenna module comprising:

a ground layer having a first ground surface and a second ground surface opposite of the first ground surface;

a first dielectric layer having a first dielectric surface and a second dielectric surface, the first dielectric surface being disposed over the first ground surface;

a second dielectric layer having a third dielectric surface and a fourth dielectric surface, the third dielectric surface being disposed over the second ground surface such that the ground layer is placed between the first and second dielectric layers;

a plurality of antenna elements being in an array arrangement and disposed on the second dielectric surface;

a feeding network being disposed over the fourth dielectric surface or placed within the second dielectric layer, wherein the feeding network is coupled to the antenna elements and wherein the feeding network is configured to function as a beam forming network and output concurrently a plurality of beams shaped according to the array arrangement of the antenna elements; and a plurality of pins connecting the feeding network to the antenna elements through at least the ground layer and the first dielectric layer.

9. The antenna module of claim 8, wherein the second dielectric surface is non-planar.

10. The antenna module of claim 8, wherein the feeding network comprises a microstrip.

11. The antenna module of claim 8, wherein the feeding network comprises a strip line.

12. The antenna module of claim 8, wherein the feeding network is configured to output concurrently the shaped beams that point to different directions.

13. The antenna module of claim 8, wherein the feeding network is configured to output concurrently the shaped beams that have different frequency bands.

14. The antenna module of claim 8, wherein the feeding network is configured to output concurrently the shaped beams that have different polarizations.

15. An antenna module comprising:

a ground layer having a first ground surface and a second ground surface opposite of the first ground surface;

a first dielectric layer having a first dielectric surface and a second dielectric surface, the first dielectric surface being disposed over the first ground surface, the second dielectric surface having a non-planar structure;

a second dielectric layer having a third dielectric surface and a fourth dielectric surface, the third dielectric surface being disposed over the second ground surface such that the ground layer is placed between the first and second dielectric layers;

a plurality of antenna elements being in an array arrangement and disposed on the non-planar structure of the second dielectric surface;

a feeding network being disposed over the fourth dielectric surface or placed within the second dielectric layer, wherein the feeding network is coupled to the antenna elements and wherein the feeding network is configured to function as a beam forming network and output concurrently a plurality of beams shaped according to the array arrangement of the antenna elements; and a plurality of pins connecting the feeding network to the antenna elements through at least the ground layer and the first dielectric layer.

16. The antenna module of claim 15, wherein the second dielectric surface comprises a plurality of connected planar surfaces that are facing different directions, the antenna elements being disposed on the connected planar surfaces.

17. The antenna module of claim 15, wherein the second dielectric surface is shaped like a pyramid and comprises four planar surfaces that are facing different directions, the antenna elements being disposed on the four planar surfaces.

18. The antenna module of claim 15, wherein the feeding network is configured to output concurrently the shaped beams that are pointing to different directions.

19. The antenna module of claim 15, wherein the feeding network comprises a microstrip or a strip line.

20. The antenna module of claim 15, wherein mismatches of feeding traces create phase differences which perform as beam weight vectors of the beam forming network.

* * * * *